US010881902B2

(12) United States Patent
Shiao et al.

(10) Patent No.: US 10,881,902 B2
(45) Date of Patent: Jan. 5, 2021

(54) ARM MUSCLE STRENGTH EXERCISE AND REHABILITATION DEVICE

(71) Applicant: NATIONAL TAIPEI UNIVERSITY OF TECHNOLOGY, Taipei (TW)

(72) Inventors: Yao-Jung Shiao, Taipei (TW); Tun-Hao Yang, Taipei (TW); Guan-Ting Chen, Kaohsiung (TW); Ming-Cheng Hsih, Taichung (TW); Cheng-Hsien Huang, New Taipei (TW); Yu-Ju Lin, New Taipei (TW)

(73) Assignee: NATIONAL TAIPEI UNIVERSITY OF TECHNOLOGY, Taipei (TW)

( * ) Notice: Subject to any disclaimer, the term of this patent is extended or adjusted under 35 U.S.C. 154(b) by 0 days.

(21) Appl. No.: 15/779,520

(22) PCT Filed: Nov. 28, 2016

(86) PCT No.: PCT/CN2016/107472
§ 371 (c)(1),
(2) Date: May 27, 2018

(87) PCT Pub. No.: WO2017/088836
PCT Pub. Date: Jun. 1, 2017

(65) Prior Publication Data

US 2018/0345074 A1 Dec. 6, 2018

Related U.S. Application Data

(60) Provisional application No. 62/260,346, filed on Nov. 27, 2015.

(51) Int. Cl.
*A63B 23/12* (2006.01)
*A63B 1/00* (2006.01)
(Continued)

(52) U.S. Cl.
CPC ..... *A63B 23/1281* (2013.01); *A63B 1/00* (2013.01); *A63B 21/00069* (2013.01);
(Continued)

(58) Field of Classification Search
CPC ..... A63B 23/1281; A63B 21/00069; A63B 2220/51; A63B 21/00058;
(Continued)

(56) References Cited

U.S. PATENT DOCUMENTS 6,113,562 A * 9/2000 Bonutti ..... A61F 5/013 602/16
10,195,097 B1 * 2/2019 Cimo ..... A61H 1/00
(Continued)

*Primary Examiner* — Loan B Jimenez
*Assistant Examiner* — Andrew M Kobylarz
(74) *Attorney, Agent, or Firm* — Anna Tsang

(57) ABSTRACT

An arm muscular strength training and rehabilitation apparatus has a body, an angle meter, a handle, a force sensing device and a main control unit. The body has a housing and a variable resistance device. The variable resistance device is disposed in the housing. The angle meter is disposed on the variable resistance device. The handle is disposed pivotally on the variable resistance device and has a suspension arm and a handlebar bracket. The force sensing device is disposed on handlebar bracket of the handle. The main control unit connects electrically to the variable resistance device, the angle meter and the force sensing device to receive the angle signal and the force sensing signal and controls resistance of the variable resistance device according to the angle signal and the force sensing signal. The apparatus disposing the force sensing device on the handle prevents measuring time lag and increase measuring precision.

13 Claims, 11 Drawing Sheets

(51) Int. Cl.
*A63B 21/00* (2006.01)
*A61H 1/02* (2006.01)

(52) U.S. Cl.
CPC ..... *A63B 23/12* (2013.01); *A61H 1/0274* (2013.01); *A63B 2220/51* (2013.01)

(58) Field of Classification Search
CPC ..... A63B 21/00181; A63B 21/00192; A63B 21/0005; A63B 21/0052; A63B 21/0056; A63B 2201/5061; A61H 1/0274; A61H 1/0285; A61H 1/2201; A61H 2201/0157; A61H 2201/1253; A61H 2201/1261; A61H 2205/065; A61H 2205/067; A61H 2201/5071; A61H 1/02
See application file for complete search history.

(56) References Cited

U.S. PATENT DOCUMENTS

2007/0137307 A1* 6/2007 Gruben ..... G01L 5/0004 73/774
2013/0060171 A1* 3/2013 Fu ..... A61H 1/02 601/5
2013/0303341 A1* 11/2013 Schroer ..... A63B 23/12 482/92
2015/0173992 A1* 6/2015 Wang ..... A61H 1/0277 601/5

* cited by examiner

ARM MUSCLE STRENGTH EXERCISE AND REHABILITATION DEVICE

BACKGROUND OF THE INVENTION

1. Field of the Invention

The present invention relates to a muscular strength training apparatus, especially to an arm muscular strength training and rehabilitation apparatus.

2. Description of Related Art

Conventional muscular strength training apparatuses or rehabilitation apparatuses mainly employ suspended weights to be resistance sources. Recently, muscular strength training apparatuses or rehabilitation apparatuses with the magnetorheological fluid technology have been developed, which control the resistance value be varying the current value. Such technology greatly reduces the dimension and total weight of the muscular strength training apparatus or rehabilitation apparatus.

When the muscular strength training apparatus or the rehabilitation apparatus has used current to adjust the resistance, the advantages are only reduced dimension and decreased weight but also reduced injuries from a user's training or rehabilitating by employing automatic weight control. Therefore, most of the conventional training apparatuses or rehabilitation apparatuses employing variable resistance sources are disposed with force sensors to detect a user's force exerting situation and according to the force exerting situation to control output of resistance. For example, a conventional arm rehabilitation apparatus uses magnetorheological fluid as a resistance outputting device and has a resistance outputting device disposed with a force sensor to detect output of resistance and a user's operation situation. A main controller of the conventional arm rehabilitation apparatus adjusts the outputting resistance of the magnetorheological fluid device according to a value detected by the force sensor such that the arm rehabilitation apparatus may be adapted for various applications.

However, because the conventional arm rehabilitation apparatus disposes the force sensor on a resistance outputting device, and a torque of the resistance outputting device measured by the force sensor is necessarily equal to the force exerted by a user to pull the handle of the arm rehabilitation apparatus. Therefore, the measurement may have certain deviation and is imprecise. Furthermore, when a user exerts a pulling force to the handle, data will only be measured by the force sensor after the resistance device rotates, a time lag occurs to cause an error such that an application extent of the arm rehabilitation apparatus is extremely limited. Moreover, because the force sensor is disposed on the resistance outputting device and has a low precision, when the device is to be shipped out from factories, disassembling the device for calibration is essential. After a period of use of the device, disassembling the device for re-calibration is also required. The calibration and maintenance procedures of the arm rehabilitation apparatus are complicated and therefore the conventional arm rehabilitation apparatus needs improvement.

SUMMARY OF THE INVENTION

With regard to the technical defects of time lag from a user' exerting force, low precision and difficulty of hardware calibration of the conventional arm rehabilitation apparatus, the present invention provides an arm muscular strength training and rehabilitation apparatus that is able to prevent measuring time lag, increase measuring precision and increase convenience of hardware calibration.

To achieve the above objective, the arm muscular strength training and rehabilitation apparatus comprises:

a body comprising a housing and a variable resistance device, the variable resistance device disposed in the housing;

a handle comprising a suspension arm and a handlebar bracket, the suspension arm disposed pivotally on the variable resistance device;

an angle meter disposed on the variable resistance device, detecting a pivotal angle of the handle relative to the variable resistance device, and outputting an angle signal;

a force sensing device disposed on the handlebar bracket of the handle and outputting a force sensing signal;

a main control unit connected electrically to the variable resistance device, the angle meter and the force sensing device, receiving the angle signal and the force sensing signal, and controlling resistance of the variable resistance device according to the angle signal and the force sensing signal.

Because the force sensing device of the arm muscular strength training and rehabilitation apparatus of the present invention is disposed on the handlebar bracket of the handle and directly detects the force exerted by a user's hands, the measuring time lag issue is prevented. Furthermore, directly measuring the force exerted by the user's hands would increase precision. Furthermore, calibration for a product of the arm muscular strength training and rehabilitation apparatus shipped out of a factory is implemented by directly adjusting the force sensing device on the handle without disassembling the arm muscular strength training and rehabilitation apparatus, which facilitate the calibrating works.

In the aspect of applications, the main control unit may be used to cooperate with a discretionary weight decreasing procedure, when the force sensing device detects the force exerted by a user but a value indicated by the angle meter does not increase in a time period, it is determined that the user is overloaded with a current weight and the variable resistance device is controlled to reduce resistance. Furthermore, because the force sensor of the arm muscular strength training and rehabilitation apparatus of the present invention is disposed on the handlebar bracket of the handle, it can serve directly as a device for detecting the user's gripping force as a rehabilitation apparatus for different purpose, which has a broader application extent.

DETAILED DESCRIPTION OF THE PREFERRED EMBODIMENT

Figure 1:
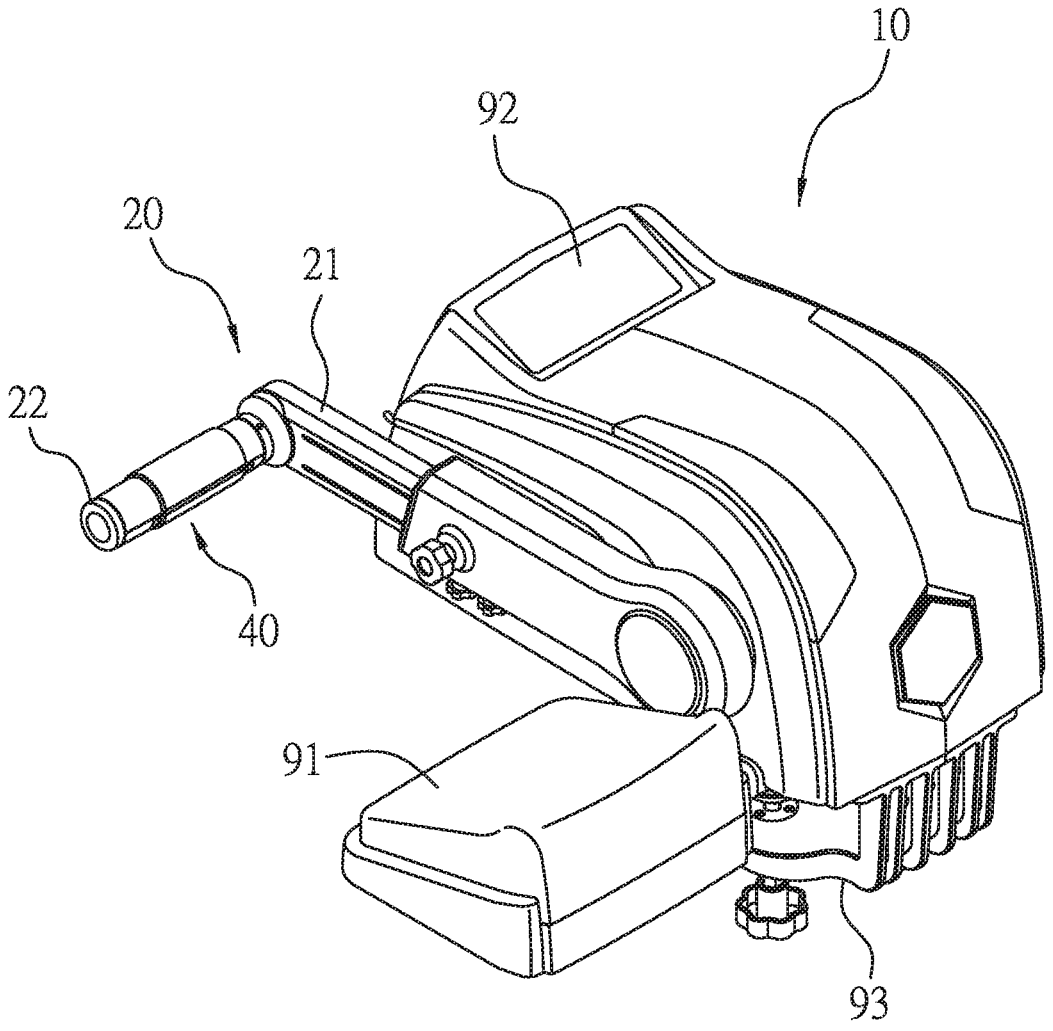
FIG. 1 is a perspective view of an arm muscular strength training and rehabilitation apparatus in accordance with the present invention.
Figure 2:
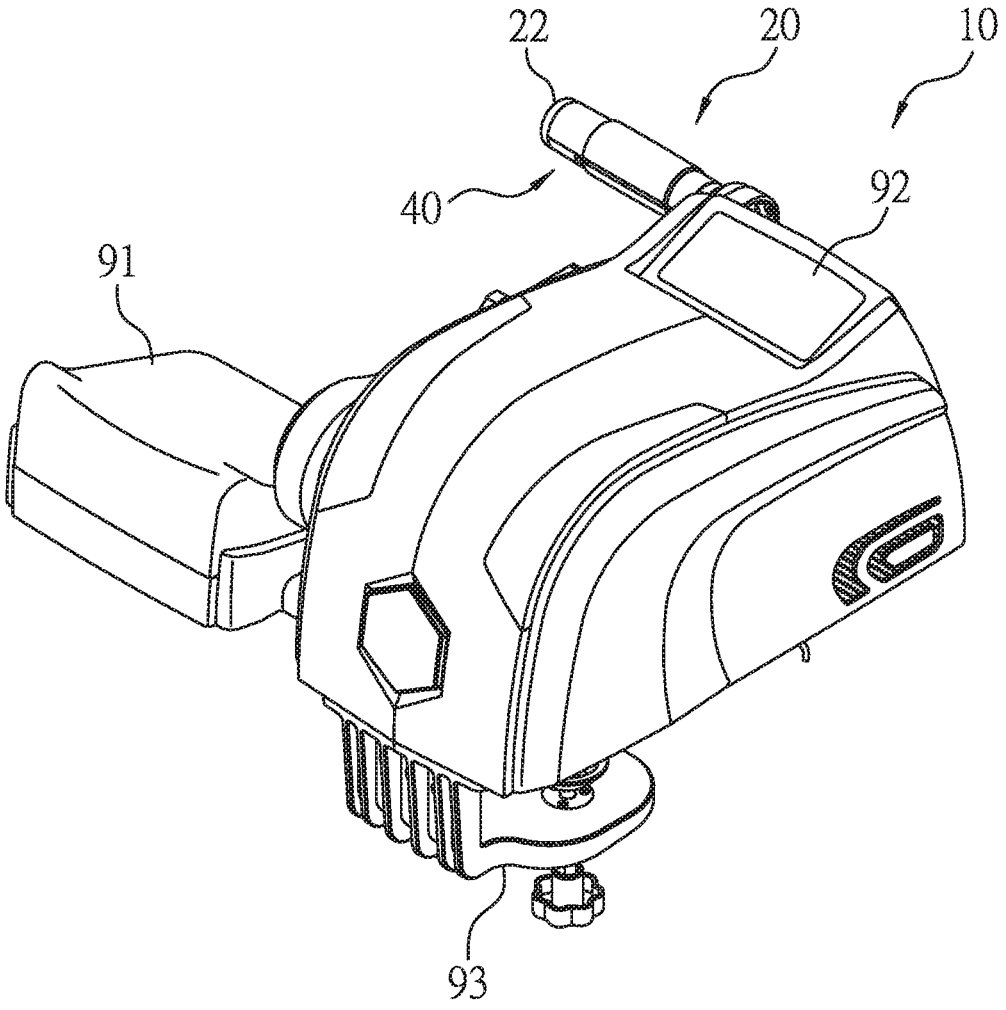
FIG. 2 is another perspective view of the arm muscular strength training and rehabilitation apparatus in FIG. 1.

With reference to FIGS. 1 to 4, an arm muscular strength training and rehabilitation apparatus of the present invention comprises a body 10, a handle 20, an angle meter 30, a force sensing device 40, and a main control unit 50.

The body 10 comprises a housing 11 and a variable resistance device 12. The variable resistance device 12 is disposed in the housing 11. In the present embodiment, the body may be further disposed with a gear set according to the type of the variable resistance device 12, and the detailed technologies thereof will be described later.

The handle 20 comprises a suspension arm 21 and a handlebar bracket 22. The suspension arm 21 is disposed pivotally on the variable resistance device 12.

The angle meter 30 is disposed on the variable resistance device 12, detects a pivotal angle of the handle 20 relative to the variable resistance device 12, and outputs an angle signal. In the present embodiment, a deceleration gear set is disposed on the variable resistance device 12, and the angle meter 30 is disposed on the deceleration gear set. Alternatively, the deceleration gear set is omitted, and the angle meter 30 is disposed directly on a pivot axis of the variable resistance device 12.

The force sensing device 40 is disposed on the handlebar bracket 22 of the handle 20, and outputs a force sensing signal.

The main control unit 50 is connected electrically to the variable resistance device 12, the angle meter 30 and the force sensing device 40, receives the angle signal and the force sensing signal, and controls resistance of the variable resistance device 12 according to the angle signal and the force sensing signal.

The present invention employs the design of disposing the force sensing device on the handle handlebar bracket and is able to directly detecting force exerted by a user's hands such the issue of measuring time lag is avoided. Furthermore, directly measuring the force of the user' hands can also improve precision, and it may measure force exerted in different ways, which will be explained as follows.

Figure 5:
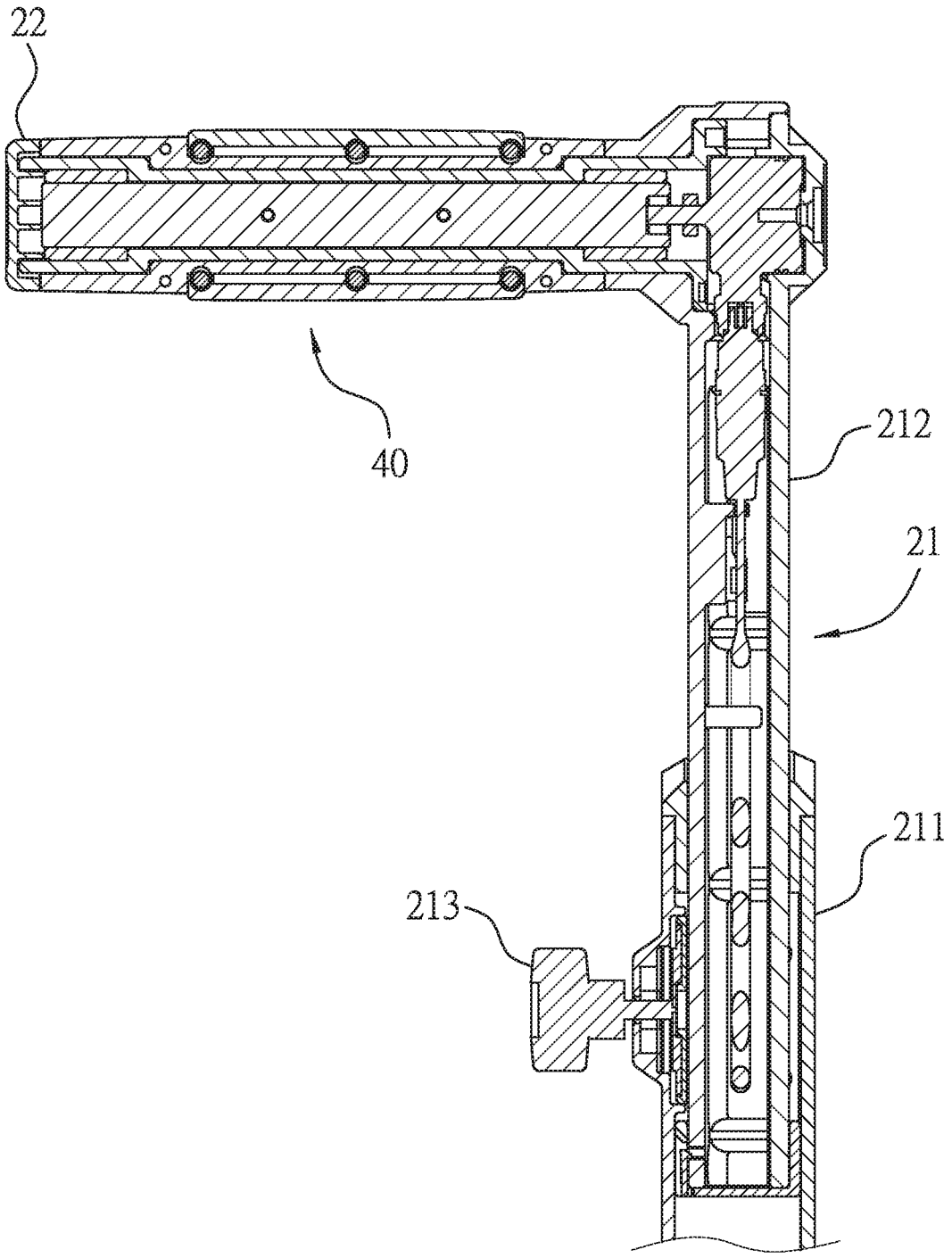
FIG. 5 is an enlarged cross sectional top view of the arm muscular strength training and rehabilitation apparatus in FIG. 1.

Detailed structures of the handle 20 will be further explained as follows. With further reference to FIG. 5, to further provide a telescopic function for the handle 20, in the present embodiment, the suspension arm 21 comprises a first arm portion 211 and a second arm portion 212. The first arm portion 211 is disposed on the variable resistance device 12, the handlebar bracket 22 is formed on the second arm portion 212. The second arm portion 212 is disposed slidably on an end of the first arm portion 211, and the first and second arm portions 211, 212 are fastened together by a fastening bolt 213. Therefore, a length of the suspension arm 21 can be adjusted by sliding the first arm portion 211 and the second arm portion 212, and the fastening bolt 213 fastens the first arm portion and the second arm portion relatively to achieve the purpose of length adjustment of the suspension arm 21.

Figure 6:
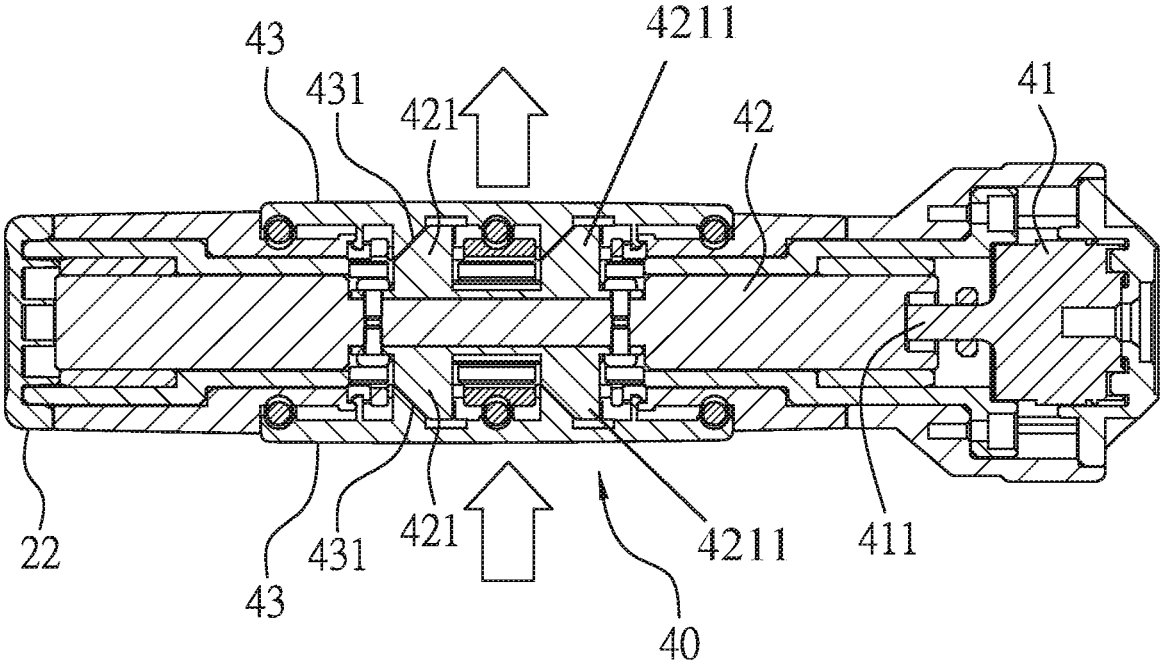
FIG. 6 is another enlarged cross sectional top view of the arm muscular strength training and rehabilitation apparatus in FIG. 1.

With further reference to FIG. 6, detailed structures of the force sensing device 40 will be explained as follows. The force sensing device comprises a force sensor 41, a slide shaft 42 and a set of lid plates 43. The force sensor 41 detects an external squeezing force, and outputs the force sensing signal. The slide shaft 42 is disposed in the handlebar bracket 22 of the handle 20, and abuts the force sensor 41. The set of the lid plates 43 cover the slide shaft 42, and pushes the slide shaft 42 to squeeze the force sensor 41 after receiving a pressure from the user's push to the slide shaft 42. In the present embodiment, the force sensor 41 comprises a pressure detecting shaft 411, and the slide shaft 42 abuts the pressure detecting shaft 411 of the force sensor 41, but is not limited thereto. If the used force sensor detects the pressure by other component, the slide shaft 42 abuts the component of the force sensor for detecting the external pressure.

The above mechanic design of the lid plates 43 pushing the slide shaft 42, in the present embodiment, is disposing a sliding compression plate 421 on the slide shaft 42. Multiple bevel blocks 4211 are formed on the sliding compression plate 421. Each of the lid plates 43 has a bevel block 431 formed on the lid plate 43, correspond to the sliding compression plate 421, and abutting one of the bevel blocks 4211 of the sliding compression plate 421, such that the lid plates 43 push the sliding compression plate 421 and drive the slide shaft 42 to squeeze the pressure detecting shaft 411 of the force sensor 41 after being pressured.

Figure 7:
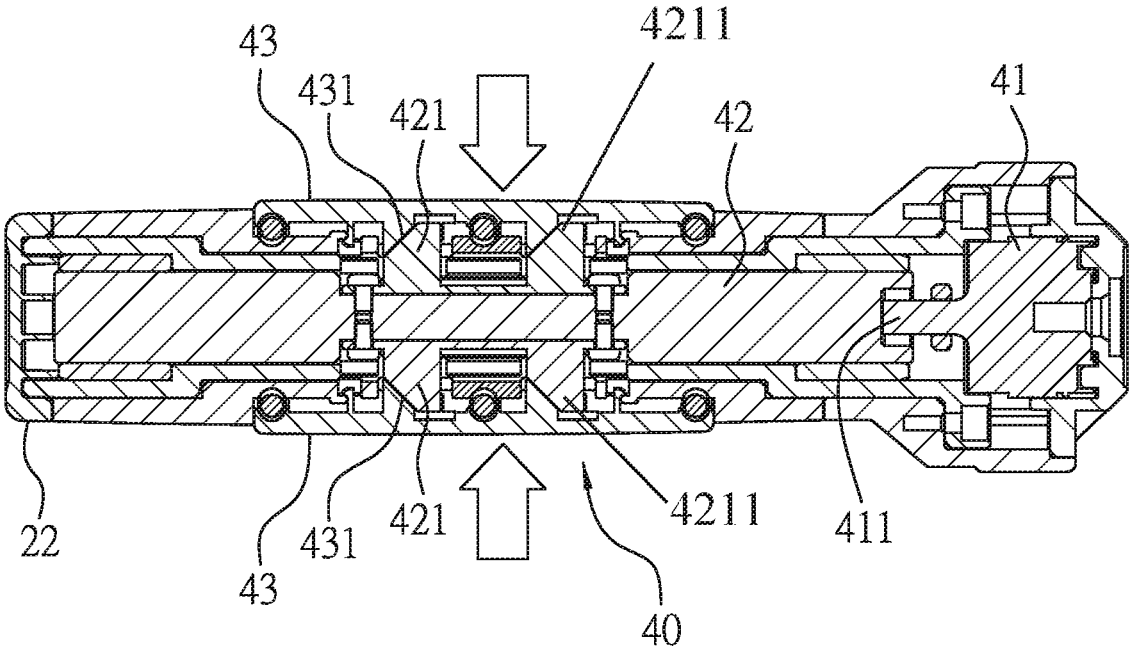
FIG. 7 is an operational enlarged cross sectional top view of the arm muscular strength training and rehabilitation apparatus in FIG. 6.

External exerting force detected by the above force sensing device of the handle 20 may be a gripping force of the user and a pulling force from the user pulling the handle 20. When the user tightly grips the handlebar bracket 22 of the handle 20, as shown in FIG. 7, the set of the lid plates 43 directly squeeze inward and push the slide shaft 42 to squeeze the pressure detecting shaft of the force sensor. Therefore, the force sensor 41 can detect the gripping force with which the user grips handle 20. When the user pulls the handle 20 upward, as shown in FIG. 6, the set of the lid plates 43 upwardly squeezes the slide shaft 42 to drives the slide shaft 42 to squeeze the pressure detecting shaft 411 of the force sensor 41. At this time, the force sensor 41 detects the user's pulling force.

Figure 8:
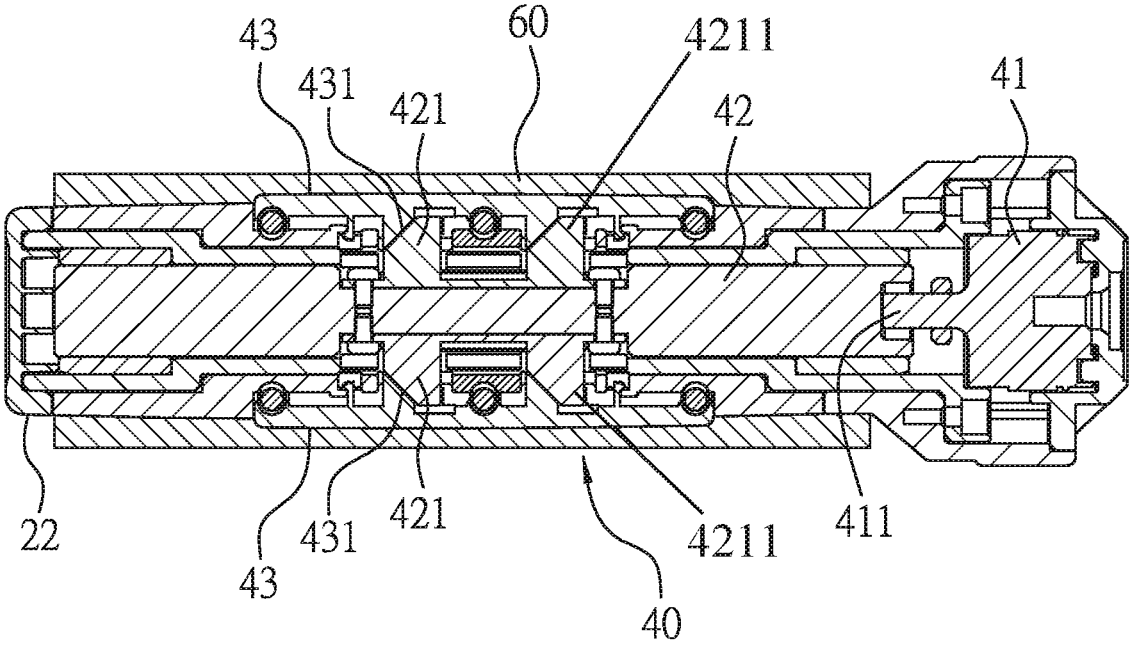
FIG. 8 is an enlarged cross sectional top view of a preferred embodiment of the arm muscular strength training and rehabilitation apparatus in accordance with present application disposed with an outer sleeve.

Because the arm muscular strength training and rehabilitation apparatus of the present invention disposing the force sensing device 40 on the handle 20 is capable of measuring the pulling force and gripping force and therefore has an extensive application extent. When the user is overloaded and cannot successfully pull the handle 20 but merely grips the handle 20 tightly, the disposed force sensing device 40 immediately detects the user's gripping force. When the present invention is further applied to a rehabilitation apparatus, the user's gripping force can be detected and trained. To measure the pulling force without affecting measuring precision to the gripping force, as shown FIG. 8, an outer sleeve 60 made of rigid material is disposed around the handle 20 to insulate the gripping force with which the user tightly grips the handle 20. Only when the handle 20 is pulled to drive the outer sleeve 60 to squeeze the set of the lid plates can the pulling force with which the user pulls the handle 20 be measured.

Besides the measurement of the pulling force and the gripping force, the arm muscular strength training and rehabilitation apparatus of the present invention disposing the force sensing device 40 on the handle 20 can also serve as finger rehabilitation apparatus. When the arm muscular strength training and rehabilitation apparatus is in use, a pulling string has one end attached to a palm or a wrist and the other end fastened on an index finger (or any other finger), and the pulling string is also hooked on the force sensing device 40 of the handle 20. Then the finger pulls the pulling string to drive the lid plate 43 to move such that the force of the finger can be measured and the finger rehabilitation can be implemented.

Because the arm muscular strength training and rehabilitation apparatus of the present invention can measure the pulling force with which the user pulls the handle 20, it will be explained as follows that a weight reduction procedure is implemented by an active unit cooperating with the measurement of the pulling force. A standard time and a standard angle is allowed to be predetermined. After the main control unit 50 receives the force sensing signal and angle signal, the standard time is counted. If the angle signal outputted by the angle meter 30 does not reach the standard angle in the standard time, it is determined that the weight is excessively heavy, and the main control unit 50 automatically reduces the resistance of the variable resistance device 12. For example, when the present invention is used for muscular strength training, standard time can be set as 2 seconds, and the standard angle can be set as N degrees. When the user fails to rotate the handle 20 to the standard angle in 2 seconds, the main control unit 50 decreases resistance of the variable resistance device 12 such that the injuries during the user's training are avoided.

Figures 9, 9A, 9B:
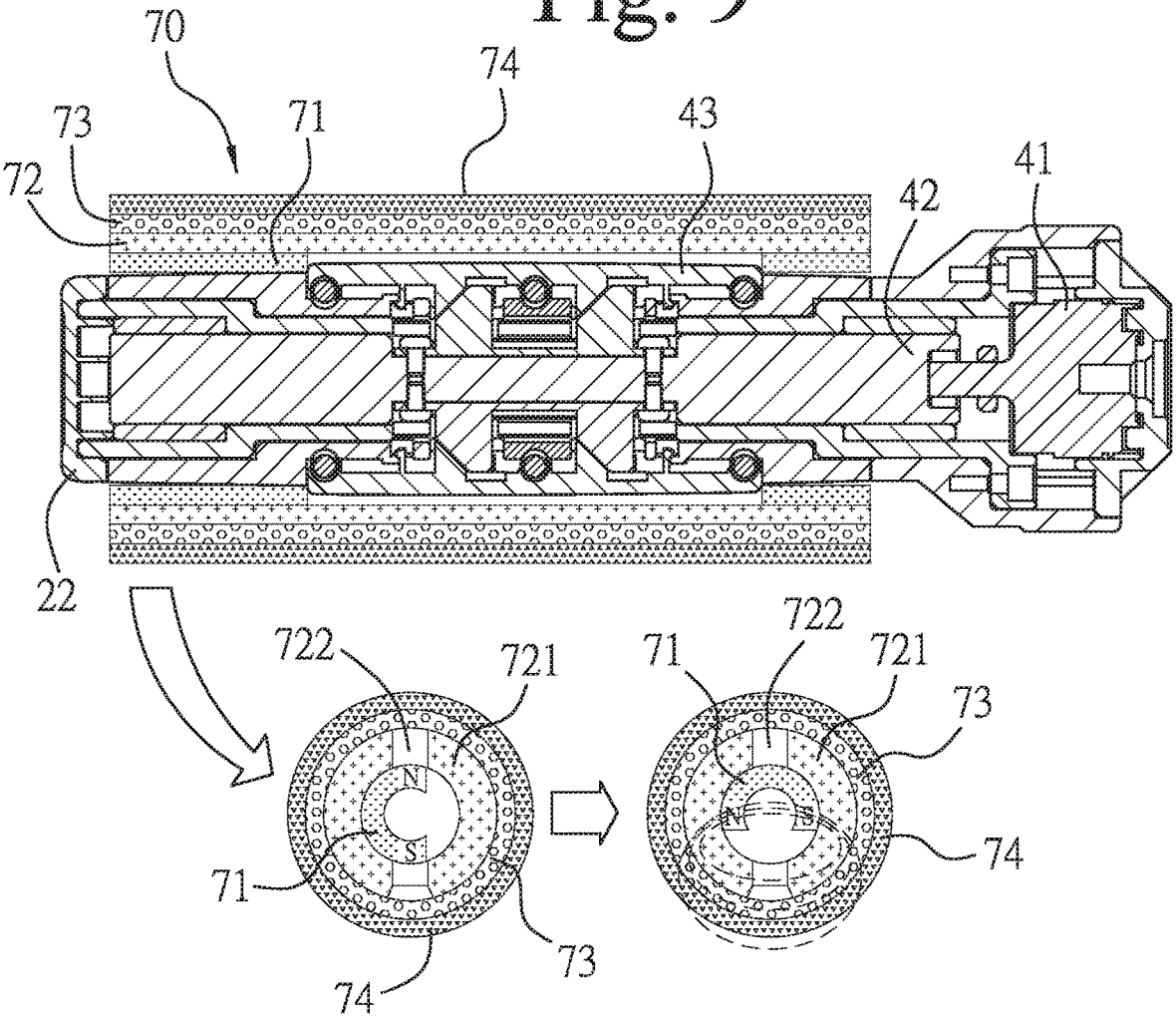
FIG. 9 is an enlarged cross sectional top view of another preferred embodiment of the arm muscular strength training and rehabilitation apparatus in accordance with present application disposed with an outer sleeve having a magnetorheological fluid.
FIG. 9A is a cross sectional end view of the arm muscular strength training and rehabilitation apparatus in FIG. 9.
FIG. 9B is an operational cross sectional end view of the arm muscular strength training and rehabilitation apparatus in FIG. 9A.

The above embodiment employs the covering outer sleeve 60 of rigid material to measure the gripping force or pulling force. When use the apparatus, the outer sleeve 60 must be detached or attached. To further improve convenience of use, another preferred embodiment, as shown in FIGS. 9, 9A and 9B, comprises an outer sleeve 70 made of magnetorheological fluid. The outer sleeve 70 comprises a rotatable magnet plate 71, a magnet covering layer 72, a magnetorheological fluid layer 73 and a soft covering layer 74. The magnet covering layer 72 covers the magnet plate 71, and has a magnetic permeable portion 721 and a magnetic insulation portion 722. The magnetic permeable portion 721 is made of high magnetic permeable material. The magnetic insulation portion 722 is made of low magnetic permeable material. The magnetorheological fluid layer 73 covers the magnet covering layer 72 and the lid plate 43 of the force sensing device 40, and is made of magnetorheological fluid material. The soft covering layer 74 covers the magnetorheological fluid layer 73. When the user is to measure the gripping force, the magnet plate 71 is rotated to align a magnetic pole with the magnetic insulation portion 722. At this time, the magnetic lines of force does not pass through the magnet covering layer 72 and the magnetorheological fluid layer 73 turns to soft material such that the gripping force from the user's grip is directly conveyed to the set of the lid plates 43 of the force sensing device 40. When the user is to measure the pulling force, the magnet plate 71 is rotated to align the magnetic pole with the magnetic permeable portion 721 of the magnet covering layer 72. The magnetic lines of force pass through magnet covering layer 72 and the magnetorheological fluid layer 73 turns to rigid material such that the gripping force cannot be conveyed to the force sensing device 40, that is, the mode turns to a pulling force measuring mode.

The above outer sleeve 70 with the magnetorheological fluid function employs the magnet plate 71 and the magnet covering layer 72 including magnetic impermeable function and magnetic permeable function to control the magnetorheological fluid layer to soften or harden. Also, the electromagnet plate or electromagnetic coil can be used to replace the magnet plate 71 and magnet covering layer 72.

Figures 10, 10A:
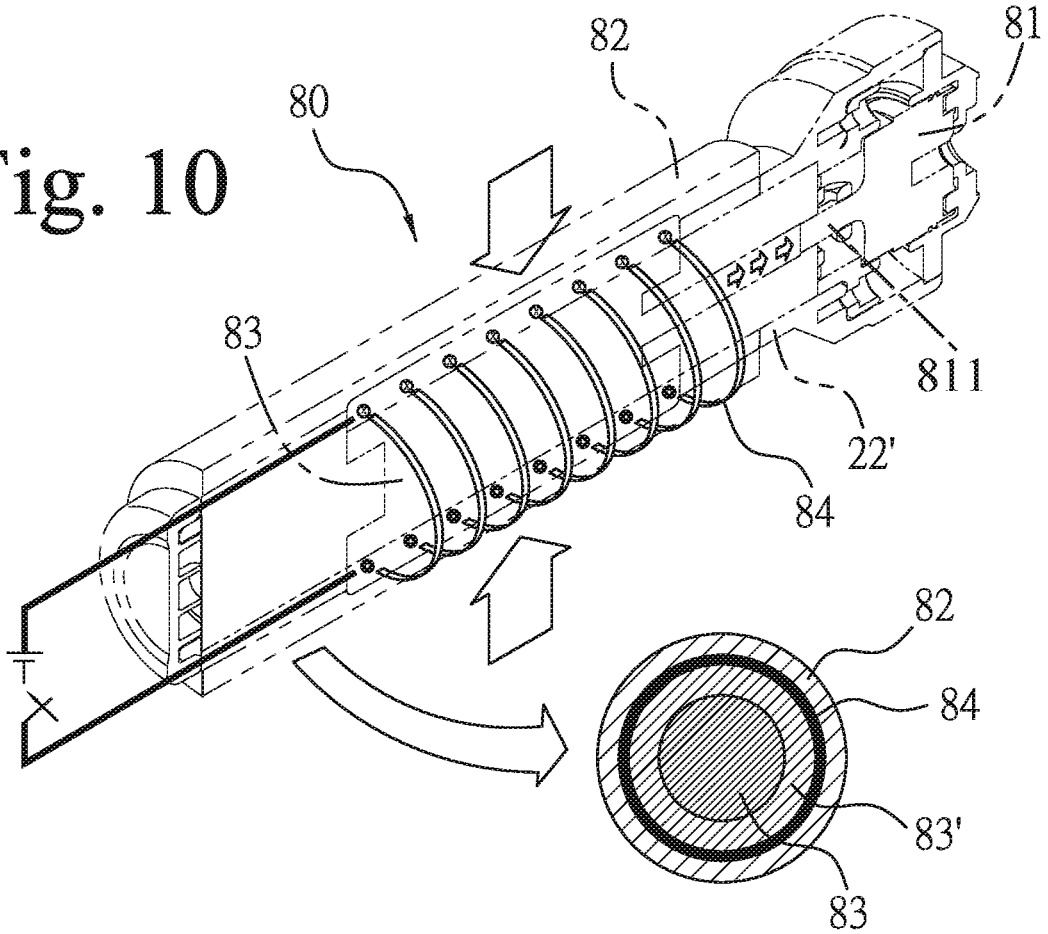
FIG. 10 is a perspective view of another preferred embodiment of the arm muscular strength training and rehabilitation apparatus in accordance with present application having a soft handlebar.
FIG. 10A is an end cross sectional view of the arm muscular strength training and rehabilitation apparatus in FIG. 10.

Besides the above embodiment, with further reference to FIGS. 10 and 10A, in the present embodiment, the force sensing device 80 is disposed on the handlebar bracket 22', and comprises a force sensor 81, a soft handlebar 82, a magnetorheological fluid substance 83 filled in the soft handlebar 82 and an electromagnetic coil 84. The force sensor 81 also comprises a pressure detecting shaft 811. The force sensor 81 and the soft handlebar 82 are disposed on the handlebar bracket 22, and the magnetorheological fluid substance 83 in the soft handlebar 82 contacts the pressure detecting shaft 811 of the force sensor 81. The electromagnetic coil 84 is disposed on an inner annular wall of the soft handlebar 82. When the electromagnetic coil 84 is electrified with current, the magnetorheological fluid substance 83' close to the electromagnetic coil 84 turns to rigid material and can insulate the gripping force with which the user grips the soft handlebar 82. When the user pulls the handle 20, the rigid magnetorheological fluid substance 83' close to the electromagnetic coil 84 squeezes the internal soft magnetorheological fluid substance 83 and further squeezes the pressure detecting shaft 811 of the force sensor 81, which is the pulling force measuring mode. When the electromagnetic coil 84 is not electrified with current, all the magnetorheological fluid substance 83, 83' turns to soft material , and the gripping force with which the user grips the soft handlebar 82 can be conveyed to the pressure detecting shaft 811 of the force sensor 81, which is the gripping force measuring mode.

The aforementioned explanation is merely aimed at the design of the force sensing device 40 of the handle 20. To improve use convenience of the arm muscular strength training and rehabilitation apparatus of the present invention, the following design can be added.

Furthermore, a hand-rest pad 91 can be disposed on a sidewall of the housing to allow the user's elbow to rest thereon.

Furthermore, a display 92 can be disposed on the housing 11. The display 92 is connected electrically to the main control unit 50 to indicate the number of times and the strength of the user's pull, operation modes, and various warnings.

Furthermore, a fastener 93 can be disposed on a bottom of the housing 11 to fasten the arm muscular strength training and rehabilitation apparatus on a table.

Furthermore, a deceleration gear set 13 can be disposed on the variable resistance device 12 such that the handle 20 and the angle meter 30 are disposed on the deceleration gear set 13. The deceleration gear set 13 can be used or idle depending on resistance outputted by the above variable resistance device 12. If the resistance outputted by the variable resistance device 12 is less, the deceleration gear set 13 is used to increase the resistance. If the resistance outputted by the variable resistance device 12 is greater, the deceleration gear set 13 is idle. The handle 20 and the angle meter 30 can be directly disposed on an axis of the variable resistance device 12.

Figure 11:
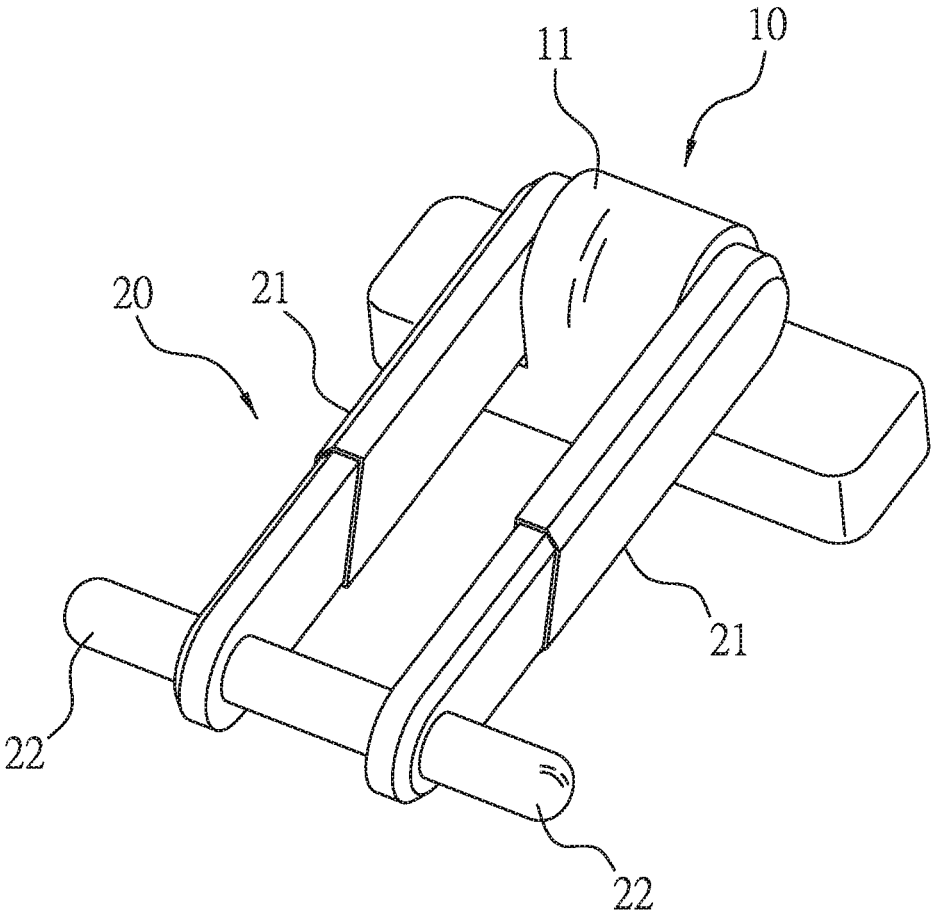
FIG. 11 is a perspective view of another preferred embodiment of the arm muscular strength training and rehabilitation apparatus in accordance with present application.

With further reference to FIG. 11, in the present embodiment, the handle 20 comprises two suspension arms 21 and two handlebar brackets 22. The two suspension arms 21 and the angle meter 30 are together disposed pivotally on the variable resistance device 12 such that the user is allowed to pulls the handle 20 with both hands, which provides dual hand training and rehabilitation function. Alternatively, one of the two suspension arms 21 and the angle meter 30 are together disposed pivotally on the variable resistance device 12, and the other suspension arm 21 is disposed pivotally on the housing 11 (or a stationary axis is disposed on the variable resistance device 12, and the suspension arm 21 is disposed on the stationary axis) such that the configuration of the variable resistance device 12 connected to external structures is simplified and the two suspension arms 21 are fastened stably on the body 10.

Figure 3:
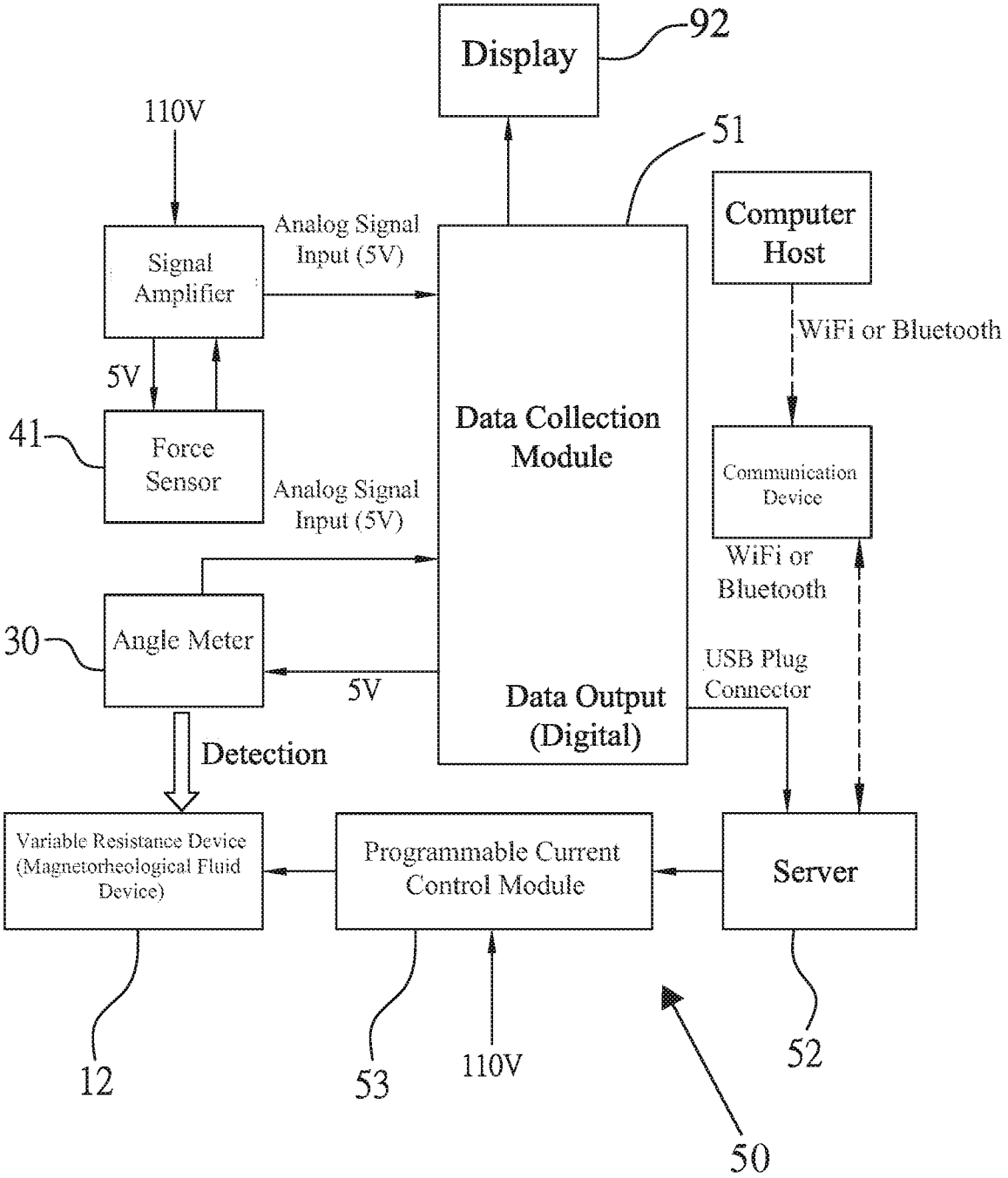
FIG. 3 is a functional block diagram of the arm muscular strength training and rehabilitation apparatus in FIG. 1.
Figure 4:
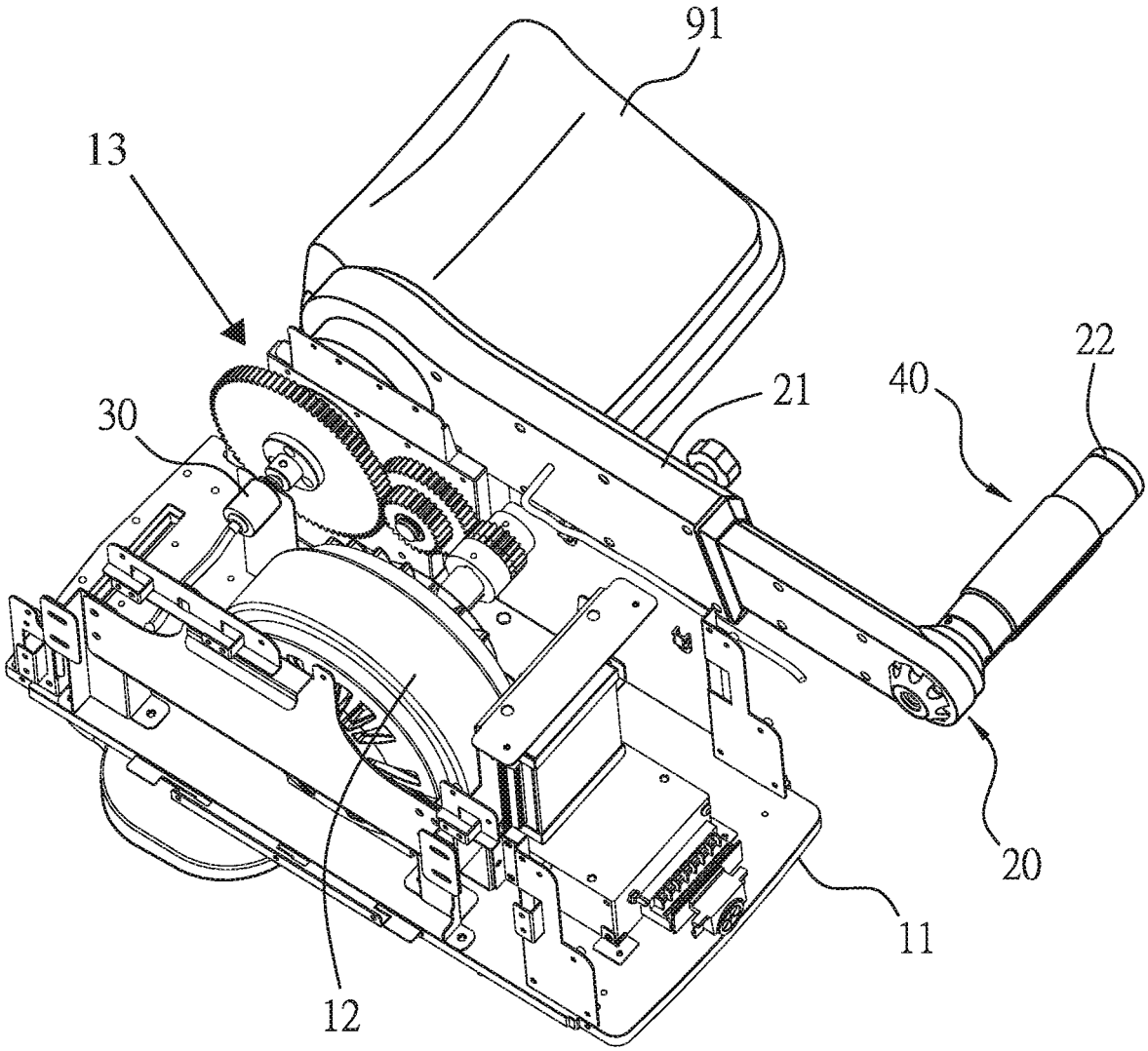
FIG. 4 is a perspective view of the arm muscular strength training and rehabilitation apparatus in FIG. 1 in which an outer cover is detached.

The above explanation is aimed at the main mechanisms of the arm muscular strength training and rehabilitation apparatus of the present invention, and a circuit of the present invention will be explained with FIG. 3 as follows. The main control unit 50 comprises a data collection module 51, a server 52, and a programmable current control module 53.

The data collection module 51 is connected electrically to the angle meter 30, the force sensor 41 of the force sensing device 40 and the display 92, and digitalizes the received angle signal and force sensing signal.

The server 52 is connected to the data collection module 51, receives the digitalized angle signal and force sensing signal, and then outputs a resistance control signal, In the present embodiment, a computer host serves as the server 52, and a universal serial bus (USB) plug connector is used to connect to the computer host. Alternatively, a notebook, cell phone or smart device can be used and connected by a general or exclusive connection cable. Also, other programmable control chip can be employed to allow the whole device to be disposed in the arm muscular strength training and rehabilitation apparatus.

The programmable current control module 53 is connected electrically to the server 52 and the variable resistance device 12, and outputs current according to the resistance control signal to control resistance of the variable resistance device 12.

Furthermore, the above server 52 can include Wi-Fi or blue-tooth transmission function to perform data transmission or remote control with external smart devices, computer host or other telecommunication devices.

Furthermore, the variable resistance device can be a servomotor with a constant torsion output, a magnet-power or magnetorheological fluid resistance device, or other variable resistance device outputting resistance based on the control of the programmable current control module.

The arm muscular strength training and rehabilitation apparatus of the present invention with direct measurement of the gripping force and pulling force on the handlebar bracket 22 of the handle 20 is able to improve measuring precision and prevent time lag errors. Furthermore, the factory calibration and later maintenance of the arm muscular strength training and rehabilitation apparatus requires no disassembly of the apparatus, which simplifies the calibration procedures. Moreover, the present invention also allows the arm muscular strength training or rehabilitation instrument to measure the gripping force and hand-pulling force, and provides the embodiment including a post weight reduction mechanism cooperating with the measurement of gripping force and pulling force such that the apparatus is able to cooperate with other software or hardware to allow more extensive development of the muscular strength training and rehabilitation.

What is claimed is:

1. An arm muscular strength training and rehabilitation apparatus comprising:

a body comprising a housing and a variable resistance device, the variable resistance device disposed in the housing;

a handle comprising a suspension arm and a handlebar bracket, the suspension arm disposed pivotally on the variable resistance device;

an angle meter disposed on the variable resistance device, detecting a pivotal angle of the handle relative to the variable resistance device, and outputting an angle signal;

a force sensing device disposed on the handlebar bracket of the handle and outputting a force sensing signal;

a main control unit connected electrically to the variable resistance device, the angle meter and the force sensing device, receiving the angle signal and the force sensing signal, and controlling resistance of the variable resistance device according to the angle signal and the force sensing signal;

wherein the force sensing device comprises:

a force sensor disposed in the handlebar bracket of the handle, detecting an external squeezing force, and outputting the force sensing signal;

a slide shaft disposed in the handlebar bracket of the handle, and abutting the force sensor; and a set of lid plates covering the slide shaft and pushing the slide shaft to squeeze the force sensor.

2. The arm muscular strength training and rehabilitation apparatus as claimed in claim 1, wherein a sliding compression plate is disposed securely on the slide shaft, the sliding compression plate has multiple bevel blocks formed on the sliding compression plate, each lid plate of the set of the lid plates has a bevel block corresponding to the sliding compression plate and abutting one of the multiple bevel blocks of the sliding compression plate such that the lid plates push the sliding compression plate and drive the slide shaft to squeeze the force sensor after being pressured.

3. The arm muscular strength training and rehabilitation apparatus as claimed in claim 2, wherein a resilient compression bar is disposed among the arm muscular strength training and rehabilitation apparatus, the set of the lid plates, and the handlebar bracket of the handle.

4. The arm muscular strength training and rehabilitation apparatus as claimed in claim 1, wherein a display is disposed on the housing, and the display is connected electrically to the main control unit.

5. The arm muscular strength training and rehabilitation apparatus as claimed in claim 4, wherein the main control unit comprises:

a data collection module connected electrically to the angle meter, the force sensing device and the display, and digitalizing the received angle signal and force sensing signal;

a server connected to the data collection module, receiving the digitalized angle signal and force sensing signal, and then outputting a resistance control signal; and a programmable current control module electrically connected to the server and the variable resistance device, and outputting current according to the resistance control signal to control resistance of the variable resistance device.

6. The arm muscular strength training and rehabilitation apparatus as claimed in claim 1, wherein an outer sleeve is disposed around each lid plate of the set of the lid plates of the force sensing device, and the outer sleeve is made of rigid material.

7. The arm muscular strength training and rehabilitation apparatus as claimed in claim 1, wherein an outer sleeve is disposed around each lid plate of the set of the lid plates of the force sensing device, and the outer sleeve comprises:

a magnet plate being rotatable;

a magnet covering layer covering the magnet plate and comprising a magnetic permeable portion and a magnetic insulation portion;

a magnetorheological fluid layer comprising the magnet covering layer and each lid plate of the set of the lid plates of the force sensing device, and the magnetorheological fluid layer is made of magnetorheological fluid material; and a soft covering layer covering the magnetorheological fluid layer.

8. The arm muscular strength training and rehabilitation apparatus as claimed in claim 1, wherein an outer sleeve is disposed around each lid plate of the set of the lid plates of the force sensing device, and the outer sleeve comprises:

an electromagnet plate;

a magnetorheological fluid layer covering each lid plate of the set of the lid plates of the electromagnet plate and the force sensing device, and the magnetorheological fluid layer is made of magnetorheological fluid material; and a soft covering layer covering the magnetorheological fluid layer.

9. The arm muscular strength training and rehabilitation apparatus as claimed in claim 1, wherein an elbow-rest pad is disposed on a sidewall of the housing.

10. The arm muscular strength training and rehabilitation apparatus as claimed in claim 1, wherein a deceleration gear set is disposed on the variable resistance device, the handle is disposed on the deceleration gear set, and the angle meter is disposed on the deceleration gear set of the variable resistance device.

11. The arm muscular strength training and rehabilitation apparatus as claimed in claim 1, wherein the suspension arm comprises a first arm portion and a second arm portion, the first arm portion is disposed on the variable resistance device, the handlebar bracket is formed on the second arm portion, the second arm portion is disposed slidably on an end of the first arm portion, and the first arm portion and the second arm portion are fastened together by a fastening bolt.

12. The arm muscular strength training and rehabilitation apparatus as claimed in claim 1, wherein the suspension arm comprises two suspension arms, the handlebar bracket comprises two handlebar brackets, and the two suspension arms are disposed pivotally on the variable resistance device.

13. An arm muscular strength training and rehabilitation apparatus comprising:

a body comprising a housing and a variable resistance device, the variable resistance device disposed in the housing;

a handle comprising a suspension arm and a handlebar bracket, the suspension arm disposed pivotally on the variable resistance device;

an angle meter disposed on the variable resistance device, detecting a pivotal angle of the handle relative to the variable resistance device, and outputting an angle signal;

a force sensing device disposed on the handlebar bracket of the handle and outputting a force sensing signal;

a main control unit connected electrically to the variable resistance device, the angle meter and the force sensing device, receiving the angle signal and the force sensing signal, and controlling resistance of the variable resistance device according to the angle signal and the force sensing signal;

wherein the force sensing device comprises:

a force sensor disposed in the handlebar bracket of the handle;

a soft handlebar disposed on the handlebar bracket;

a magnetorheological fluid substance filled in the soft handlebar and contacting the force sensor; and an electromagnetic coil disposed on an inner annular wall of the soft handlebar.

* * * * *